US009429029B2

(12) United States Patent
Macchia et al.

(10) Patent No.: US 9,429,029 B2
(45) Date of Patent: Aug. 30, 2016

(54) GAS TURBINE BLADE AND METHOD OF PROTECTING SAME

(75) Inventors: Enzo Macchia, Kleinburg (CA); Barry Barnett, Markham (CA); Andreas Eleftheriou, Woodbridge (CA); Tom McDonough, Barrie (CA); George Guglielmin, Toronto (CA); Joe Lanzino, Orangeville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 1281 days.

(21) Appl. No.: 13/189,043

(22) Filed: Jul. 22, 2011

(65) Prior Publication Data

US 2012/0082551 A1 Apr. 5, 2012

Related U.S. Application Data

(60) Provisional application No. 61/388,352, filed on Sep. 30, 2010.

(51) Int. Cl.
*F03B 3/12* (2006.01)
*F01D 5/30* (2006.01)

(52) U.S. Cl.
CPC ..... *F01D 5/3092* (2013.01); *F05B 2230/90* (2013.01); *F05D 2230/90* (2013.01)

(58) Field of Classification Search
CPC ..... F05D 2300/00; F05D 2300/10; F05D 2300/20; F05D 2300/30; F05D 2300/40; F05D 2300/50; F05D 2300/611; F05D 2300/60; F01D 5/288; F01D 25/00; B32B 9/00
USPC ..... 416/219 R
See application file for complete search history.

(56) References Cited

U.S. PATENT DOCUMENTS

| | | | |
|---|---|---|---|
| 2,581,252 | A | 1/1952 | Goetzel et al. |
| 3,291,382 | A | 12/1966 | Vaughau et al. |
| 3,892,612 | A | 7/1975 | Carlson et al. |
| 4,023,249 | A | 5/1977 | Darrow et al. |
| 4,063,847 | A | 12/1977 | Simmons |
| 4,377,370 | A | 3/1983 | Porcelli |
| 4,619,699 | A | 10/1986 | Petkovic-Luton et al. |
| 4,655,682 | A | 4/1987 | Kunz et al. |

(Continued)

FOREIGN PATENT DOCUMENTS

| | | |
|---|---|---|
| EP | 229519 | 11/1996 |
| JP | 1-200003 A | 8/1989 |

(Continued)

OTHER PUBLICATIONS www.repliforminc.com/products.htm#RePliKote, Copyright 2006.

(Continued)

*Primary Examiner* — Craig Kim
*Assistant Examiner* — Jason Fountain
(74) *Attorney, Agent, or Firm* — Norton Rose Fulbright Canada LLP

(57) ABSTRACT

An airfoil blade of a gas turbine engine includes a root configured for mating attachment with a cooperating rotor hub and an airfoil extending away from the root. The root is composed of a first metal and has a nanocrystalline metal coating, composed of a second metal, over at least a portion thereof. A method of protecting such a blade by applying a nanocrystalline metal coating to a portion of the blade root is also disclosed.

13 Claims, 3 Drawing Sheets

(56) References Cited

U.S. PATENT DOCUMENTS

| | | | | |
|---|---|---|---|---|
| 4,921,405 | A | 5/1990 | Wilson | |
| 4,957,415 | A | 9/1990 | Paul et al. | |
| 5,149,251 | A | 9/1992 | Scanlon et al. | |
| 5,252,160 | A | 10/1993 | Scanlon et al. | |
| 5,314,304 | A | 5/1994 | Wiebe | |
| 5,358,029 | A | 10/1994 | Baveja et al. | |
| 5,449,273 | A | 9/1995 | Hertel et al. | |
| 5,486,096 | A | 1/1996 | Hertel et al. | |
| 5,601,933 | A * | 2/1997 | Hajmrle et al. | 428/660 |
| 5,635,654 | A | 6/1997 | Hebsur et al. | |
| 5,881,972 | A | 3/1999 | Smith et al. | |
| 6,110,604 | A | 8/2000 | Rickerby | |
| 6,341,747 | B1 * | 1/2002 | Schmidt et al. | 244/123.1 |
| 6,358,014 | B1 | 3/2002 | Chou et al. | |
| 6,482,532 | B1 | 11/2002 | Yap et al. | |
| 6,482,537 | B1 | 11/2002 | Strangman et al. | |
| 6,617,049 | B2 | 9/2003 | Darolia et al. | |
| 6,620,525 | B1 | 9/2003 | Rigney et al. | |
| 6,723,387 | B1 | 4/2004 | Kear et al. | |
| 6,729,846 | B1 | 5/2004 | Wobben | |
| 6,773,817 | B1 * | 8/2004 | Sagel | C22C 45/001 416/241 R |
| 6,875,529 | B1 | 4/2005 | Spitsberg et al. | |
| 6,887,589 | B2 | 5/2005 | Pfaendtner et al. | |
| 6,973,792 | B2 | 12/2005 | Hicks | |
| 7,080,973 | B2 | 7/2006 | Tung et al. | |
| 7,108,485 | B2 | 9/2006 | Wobben | |
| 7,186,092 | B2 | 3/2007 | Bruce et al. | |
| 7,247,348 | B2 * | 7/2007 | Power | 427/249.7 |
| 7,300,708 | B2 * | 11/2007 | Gigliotti et al. | 428/632 |
| 7,311,981 | B2 * | 12/2007 | Saint Ramond et al. | 428/632 |
| 7,320,832 | B2 | 1/2008 | Palumbo et al. | |
| 7,344,675 | B2 | 3/2008 | Van Daam et al. | |
| 7,354,354 | B2 | 4/2008 | Palumbo et al. | |
| 7,354,490 | B2 | 4/2008 | Fritzemeier et al. | |
| 7,361,386 | B2 | 4/2008 | Kim et al. | |
| 7,364,806 | B2 | 4/2008 | Matsumoto et al. | |
| 7,387,578 | B2 * | 6/2008 | Palumbo et al. | 473/320 |
| 7,387,587 | B2 | 6/2008 | Dean | |
| 7,431,566 | B2 | 10/2008 | Gray et al. | |
| 7,517,930 | B2 | 4/2009 | Eschborn et al. | |
| 7,640,661 | B2 | 1/2010 | Despreaux et al. | |
| 7,662,207 | B2 | 2/2010 | Miura et al. | |
| 7,740,960 | B1 | 6/2010 | Zhu et al. | |
| 7,753,653 | B2 | 7/2010 | Cairo et al. | |
| 7,758,306 | B2 | 7/2010 | Burton et al. | |
| 7,766,623 | B2 | 8/2010 | Chou et al. | |
| 7,775,772 | B2 | 8/2010 | Carrier et al. | |
| 7,784,182 | B2 | 8/2010 | Carrier et al. | |
| 7,824,507 | B2 | 11/2010 | Van Daam et al. | |
| 7,914,256 | B2 | 3/2011 | Xie et al. | |
| 7,942,638 | B2 * | 5/2011 | Eichmann et al. | 416/229 A |
| 8,545,994 | B2 | 10/2013 | Facchini et al. | |
| 2002/0045053 | A1 | 4/2002 | Hoskin | |
| 2003/0138301 | A1 * | 7/2003 | Kuerzel | 407/34 |
| 2004/0172827 | A1 | 9/2004 | Kinstler et al. | |
| 2004/0219010 | A1 | 11/2004 | Merrill et al. | |
| 2005/0133121 | A1 * | 6/2005 | Subramanian et al. | 148/325 |
| 2005/0135928 | A1 | 6/2005 | Servadio et al. | |
| 2005/0205425 | A1 | 9/2005 | Palumbo et al. | |
| 2005/0255329 | A1 * | 11/2005 | Hazel | 428/472 |
| 2005/0260078 | A1 * | 11/2005 | Potter et al. | 416/219 R |
| 2005/0278950 | A1 | 12/2005 | Despreaux et al. | |
| 2006/0147688 | A1 * | 7/2006 | Subramanian et al. | 428/292.1 |
| 2006/0193742 | A1 | 8/2006 | Miura et al. | |
| 2007/0087185 | A1 | 4/2007 | Wei et al. | |
| 2007/0099027 | A1 * | 5/2007 | Krishnamurthy et al. | 428/698 |
| 2007/0140853 | A1 * | 6/2007 | McCann et al. | 416/193 A |
| 2007/0141370 | A1 | 6/2007 | Kerber | |
| 2007/0163114 | A1 | 7/2007 | Johnson | |
| 2007/0190245 | A1 | 8/2007 | Gupta et al. | |
| 2008/0145649 | A1 * | 6/2008 | Mannem et al. | 428/336 |
| 2008/0170943 | A1 | 7/2008 | Cairo et al. | |
| 2008/0216383 | A1 | 9/2008 | Pierick et al. | |
| 2008/0298976 | A1 | 12/2008 | Kriegl | |
| 2009/0016894 | A1 | 1/2009 | Strother | |
| 2009/0028697 | A1 | 1/2009 | Shi et al. | |
| 2009/0055339 | A1 | 2/2009 | Bernard | |
| 2009/0081032 | A1 | 3/2009 | Moroso et al. | |
| 2009/0120101 | A1 | 5/2009 | Lomasney et al. | |
| 2009/0229984 | A1 * | 9/2009 | Schuh et al. | 205/50 |
| 2010/0055339 | A1 * | 3/2010 | Shinde et al. | 427/451 |
| 2010/0226782 | A1 | 9/2010 | Eichmann et al. | |
| 2010/0304063 | A1 | 12/2010 | McCrea et al. | |
| 2010/0304065 | A1 | 12/2010 | Tomantschger et al. | |
| 2010/0304171 | A1 | 12/2010 | Tomantschger et al. | |
| 2010/0304172 | A1 | 12/2010 | Facchini et al. | |
| 2010/0304179 | A1 | 12/2010 | Facchini et al. | |
| 2010/0304181 | A1 * | 12/2010 | Anand et al. | 428/627 |
| 2011/0020548 | A1 * | 1/2011 | Eichmann et al. | 427/282 |
| 2011/0176927 | A1 | 7/2011 | Alexander et al. | |
| 2011/0211967 | A1 | 9/2011 | Deal et al. | |
| 2011/0287223 | A1 | 11/2011 | Victor et al. | |
| 2012/0051935 | A1 | 3/2012 | Naik et al. | |
| 2012/0082553 | A1 | 4/2012 | Eleftheriou | |
| 2012/0082556 | A1 | 4/2012 | Macchia et al. | |
| 2012/0175534 | A1 | 7/2012 | Jung et al. | |

FOREIGN PATENT DOCUMENTS

| | | |
|---|---|---|
| JP | 6-159003 A | 6/1994 |
| WO | 2009006871 | 1/2009 |
| WO | 2009006871 A2 | 1/2009 |

OTHER PUBLICATIONS

Izumi, Method of Adhering Anticorrosion piece in turbine blade, Aug. 11, 1989, PAJ, Abstract of JP1-200003A.

Aoki, Gas Turbine Blade, Jun. 7, 1994, PAJ, Abstract of JP6-159003A.

Tjong, Nanocrystalline Materials and Coatings, Aug. 10, 2004.

Lima, Microstructural Characteristics of Cold-Sprayed Nanostructured WC-Co Coatings, Jul. 2002, Thin Solid Films 416, 129-135.

Integran Technologies Inc.: http://www.integran.com/pages/nano_ns.html.

* cited by examiner

GAS TURBINE BLADE AND METHOD OF PROTECTING SAME

CROSS-REFERENCE TO RELATED APPLICATIONS

The present application claims priority on U.S. Provisional Patent Application No. 61/388,352 filed Sep. 30, 2010, the entire contents of which is incorporated herein by reference.

TECHNICAL FIELD

The application relates generally to gas turbine engines and, more particularly, to blades thereof.

BACKGROUND OF THE ART

Gas turbine blades, particularly fan blades, experience excessive galling and wear on the pressure surfaces of the dovetail regions at the root of the blades. This is especially true for titanium (Ti) blades mounted on titanium hubs, with the Ti on Ti contact resulting in high coefficients of friction and high material transfer rates. This results in premature blade retirement and a significant increase in maintenance costs. Additionally, surface contact points, under conditions of blade wind milling are subject to many cycles of low contact loads that result in wear. Traditionally, gas turbine manufacturers have overcome these issues by reducing contact stress levels, for example by using sacrificial shims such as shown in U.S. Pat. No. 5,160,243. The problem with these shims is that they require periodic replacement, add fan blade assembly complications, and this may result in fragment release if they fail. Accordingly, there is a need to provide improved blade dovetail protection.

SUMMARY

In accordance with one aspect of the present application, there is provided an airfoil blade of a gas turbine engine comprising a root configured for mating attachment with a cooperating rotor hub and an airfoil extending, away from the root, the root being composed of a first metal and having a nanocrystalline metal coating over at least a portion of the root, the nanocrystalline metal coating being composed of a second metal different from the first metal.

In accordance with another aspect of the present application, there s also provided a method of protecting a blade of a gas turbine engine having a blade root and an airfoil extending therefrom, the method comprising the steps of: preparing at least a portion of a dovetail of the blade root for coating; and then applying a nanocrystalline metal coating to said portion.

DESCRIPTION OF THE DRAWINGS

Reference is now made to the accompanying figures in which.

DETAILED DESCRIPTION

Figure 1:
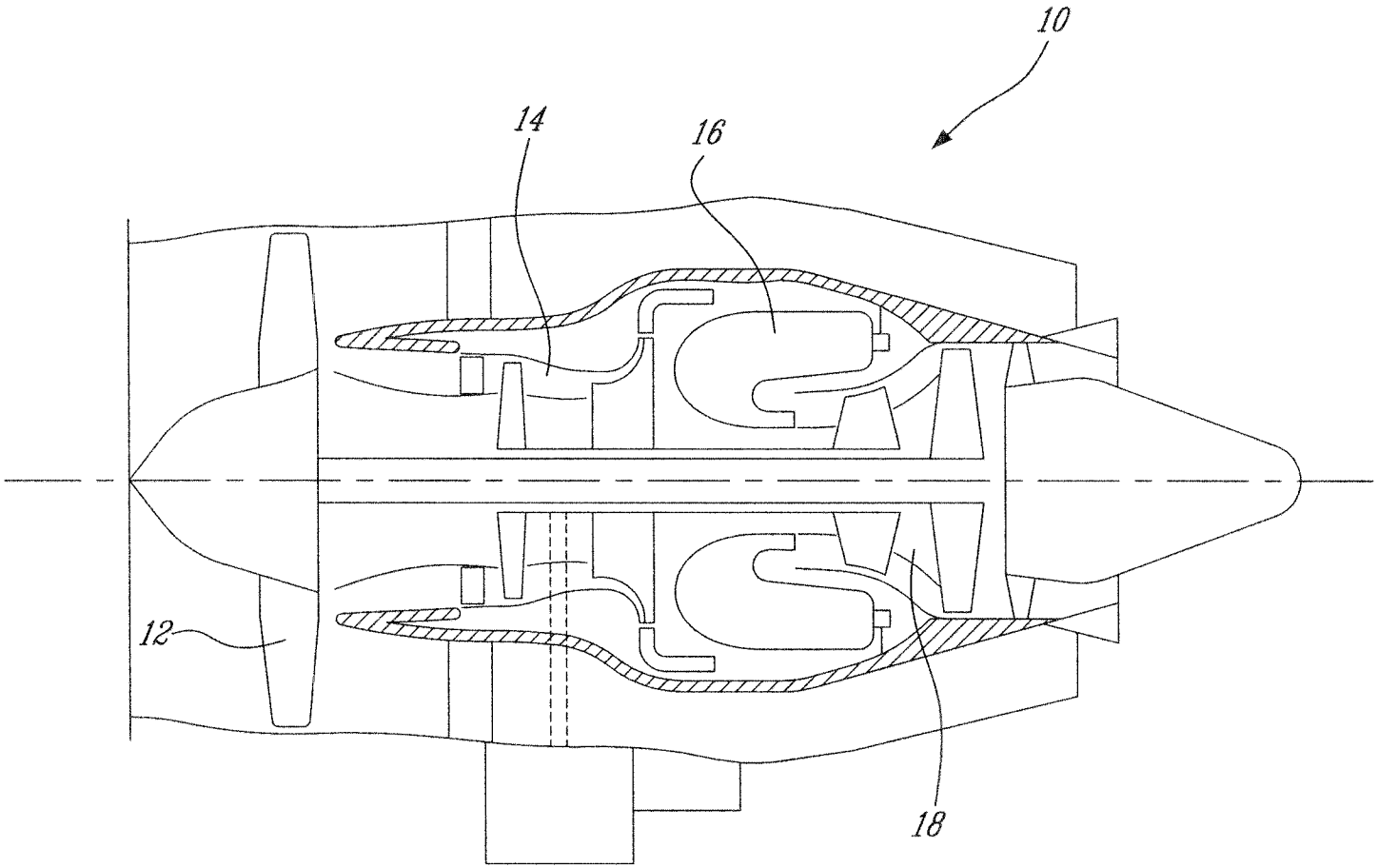
FIG. 1 is a schematic cross-sectional view of a gas turbine engine according to the present description.

FIG. 1 illustrates a gas turbine engine 10, generally comprising in serial flow communication, a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
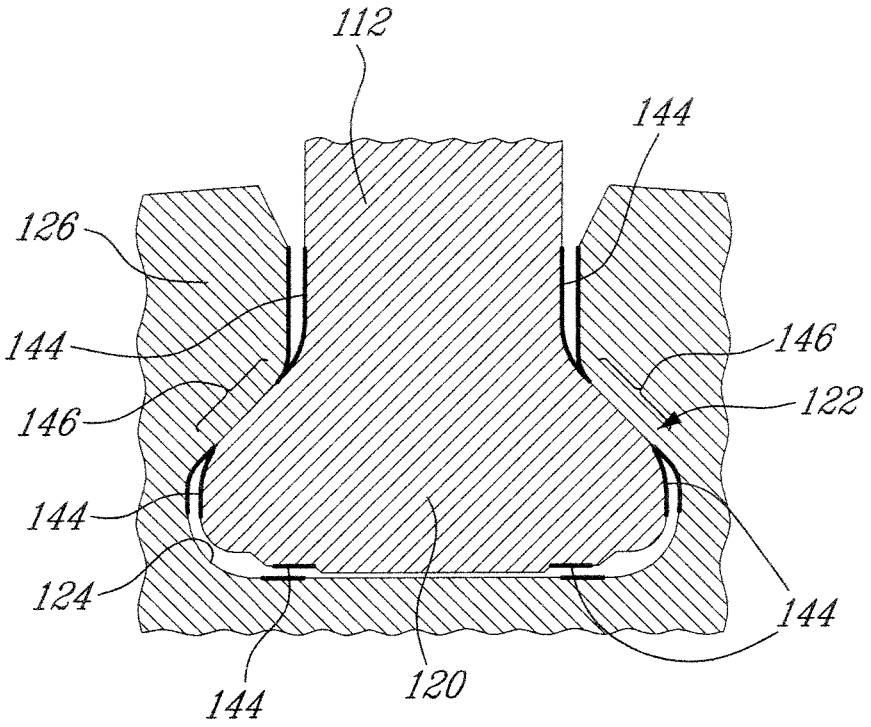
FIG. 2 (Prior Art)
FIG. 2 is a cross-sectional view of a portion of a prior art fan blade dovetail, showing the wear and damage typical to conventional designs.

Referring to FIG. 2, a typical fan blade 112 of the prior art has a blade root 120 having a dovetailed shape portion at is proximal end (and which root is thus often simply referred to as a "dovetail"). The dovetail of the root 120 has a pressure side surface 122 that is subject to wear of the type described above. The dovetail 120 of the root of the blade 112 fits within corresponding dovetail-shaped slots 124 in the disk lug 126. While the wear areas 144 as shown in FIG. 2 may be prone to some wear and thus also experience deterioration with time during use, the fretting areas 146 on sloping surfaces of the dovetail 120 are most particularly subject to fretting wear of the type noted above.

Figure 3:
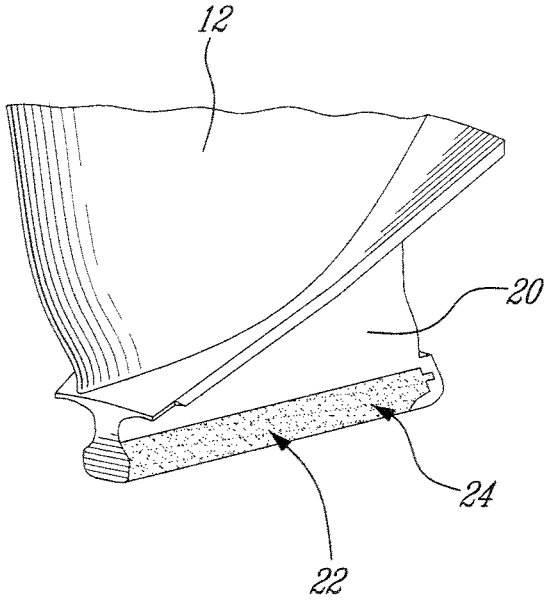
FIG. 3 is an enlarged isometric view of a fan blade of the engine of FIG. 1, dovetail of the fan blade root.
Figure 4:
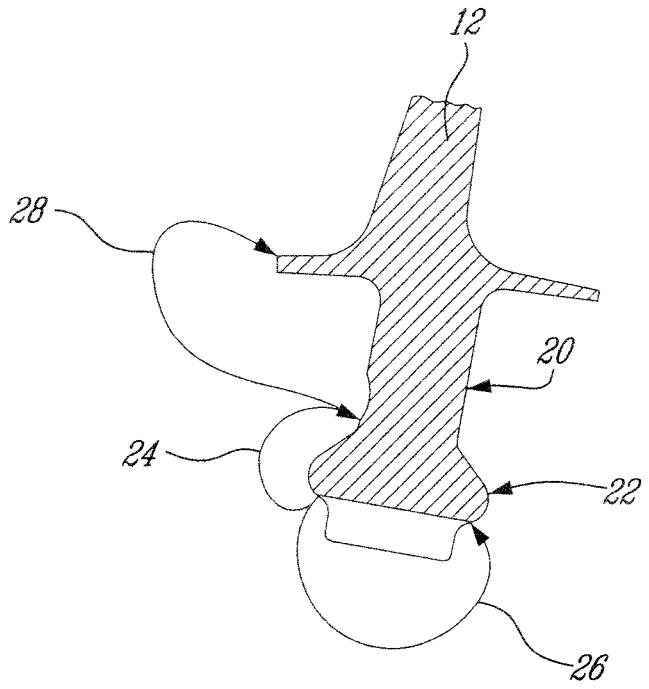
FIG. 4 is a enlarged partial cross-section of one example of a fan blade according to FIG. 3.

Referring to FIG. 3, the blade 12 in accordance with one embodiment of the present disclosure has a blade root or dovetail 20 having a wear surface 22 thereon that is provided with a nanocrystalline metal coating (nano coating) 24 thereon. The wear surface, or bearing surface, may be for example a region of expected fretting wear corresponding to the fretting areas 146 described above, and thus may comprise an angled bearing surface which contacts a corresponding surface within the dovetail slot of the hub. The nanocrystalline metal coating 24 is, in at least one embodiment, applied to at least the wear surface 22 on the pressure side of the dovetail. However, it is understood that the nanocrystalline metal coating 24 may be provided on both the pressure and suction sides of the dovetail, either exclusively in the wear surface areas 22 or beyond (including covering the entire blade root, for example). The nanocrystalline metal coating 24, such as Nanovate (a trademark of Integran Technologies) nickel (Ni) or copper (Cu), is applied to at least the pressure side wear surface 22 of the fan blade, in order to provide a wear-resistant surface to the blade. The nanocrystalline metal coating 24 may be applied to the dovetail pressure side wear surface 22 only, or alternately may be applied to more of, including the entirety of the dovetail 20, as shown in FIG. 4 for example.

A plating technique, or other suitable method, may be used to deposit the selected nanocrystalline metal material (example: nNi or nCu) with a nanocrystalline grain structure onto the blade dovetail. The nanocrystalline metal coating (or simply "nano coating") may also reduce friction coefficients between the blade 12 and the hub within which it is received.

The thickness of the nano coating may typically range between about 0.001 inch to about 0.125 inch (about 0.0254 mm to about 3.175 mm), and more preferably between 0.001 inch (0.0254 mm) and 0.008 inch (0.2032 mm), but may depend on the clearance available in the design. In one particular example, the nanocrystalline metal coating is about 0.005 inches (0.127 mm) in thickness. In another example, coating thickness varies so as to be locally thicker in regions where higher load contact stresses are present.

The coating provides a surface of a material dissimilar to the blade hub, which would reduce galling caused in conventional assemblies by contact between similar materials used for blade root and hub. Using a coating procedure as described herein may also simplify the assembly relative to prior art designs employing shims and other anti-wear devices.

The nanocrystalline metal coating may be applied directly to the substrate, such as the titanium dovetail, or to an intermediate bond coat on the substrate. The intermediate bond coat may improve bond strength and structural performance of the nanocrystalline metal coating, in the event that improved bonding between the substrate and nanocrystalline metal coating is deemed to be required.

The nanocrystalline metal coating 24 forms an outer layer which acts structurally to strengthen the dovetail and to protect it against wear and fretting. Due to the nanocrystalline grain size, the nano coating provides for improved structural properties of the dovetail. The coating metal grain size may range between about 2 nm and 5000 nm. The nano coating may be a pure nickel (Ni), pure copper (Cu), cobalt-phosphorous (CoP) or another suitable metal or metal alloy, such as Co, Cr, Fe, Mo, Ti, W, or Zr. The manipulation of the metal grain size, when processed according to the methods described below, produces the desired mechanical properties. The nanocrystalline metal coating may be composed of a pure metal, such as Ni or Co for example. It is to be understood that the term "pure" as used herein is intended to include a metal comprising trace elements of other components. As such, in a particular embodiment, the nano metal topcoat 52 comprises a pure Nickel coating which includes trace elements such as, but not limited to: Carbon (C)=200 parts per million (ppm), Sulfur (S)<500 ppm, Cobalt (Co)=10 ppm, and Oxygen (O)=100 ppm.

The nanocrystalline metal coating 24 may be a pure metal selected from the group consisting of: Ag, Al, Au, Co, Cu, Cr, Sn, Fe, Mo, Ni, Pt, Ti, W, Zn and Zr, and is purposely pure (i.e. not alloyed with other elements). The manipulation of the metal grain size, produces the desired mechanical properties for the gas turbine engine blade. In a particular embodiment, the pure metal of the nanocrystalline metal coating 24 is a pure nickel (Ni) or cobalt (Co), such as for example Nanovate™ nickel or cobalt (trademark of Integran Technologies Inc.) respectively, although other metals can alternately be used, such as for example copper (Cu) or one of the above-mentioned metals. The nanocrystalline metal coating is intended to be a pure nano-scale Ni, Co, Cu, etc. and is purposely not alloyed to obtain specific material properties. As noted above, it is to be understood that the term "pure" is intended to include a metal perhaps comprising trace elements of other components but otherwise unalloyed with another metal.

In the above example, the nano coating is applied through a plating process in a bath, to apply the fine-grained (i.e. nano-scale) metallic coating to the article, however any suitable plating or other coating process can be used, such as for instance the plating processes described in U.S. Pat. No. 5,352,266 issued Oct. 4, 1994; U.S. Pat. No. 5,433,797 issued Jul. 18, 1995; U.S. Pat. No. 7,425,255 issued Sep. 16, 2008; U.S. Pat. No. 7,387,578 issued Jun. 17, 2008; U.S. Pat. No. 7,354,354 issued Apr. 8, 2008; U.S. Pat. No. 7,591,745 issued Sep. 22, 2009; U.S. Pat. No. 7,387,587 B2 issued Jun. 17, 2008 and U.S. Pat. No. 7,320,832 issued Jan. 22, 2008, the entire contents of each of which are incorporated herein by reference. Any suitable number of plating layers (including one or multiple layers of different grain size, and/or a larger layer having graded average grain size and/or graded composition within the layer) may be provided. The nanocrystalline metal(s) used is/are variously described in the patents incorporated by reference above.

The nanocrystalline metal coating 24 has a fine grain size, which provides improved structural properties to the blade root. The nanocrystalline metal coating is a fine-grained metal, having an average grain size at least in the range of between 1 nm and 5000 nm. In a particular embodiment, the nanocrystalline metal coating has an average grain size of between about 10 nm and about 500 nm. More preferably, in another embodiment the nanocrystalline metal coating has an average grain size of between 10 nm and 50 nm, and more preferably still an average grain size of between 10 nm and 15 nm.

In another embodiment, the above-described nanocrystalline metal coating is applied to a conventional fan blade which has already experienced fretting and wear of the type described above—i.e. the coating is applied over the worn but reworked and refinished surface, which may permit the re-entry into service of a fan blade which otherwise would have been required to be retired from service and scrapped. Hence, the application of the nanocrystalline metal coating may be used as a method of repairing worn blades, thereby structurally strengthening the fan blades and providing them with a shield against further wear. In the case where the worn blade is titanium, as is the hub, the application of a non-titanium nano coating, such as those described above, will prevent direct Ti on Ti contact, which may assist in preventing high friction and cohesive material transfer caused by such contact.

Figure 5:
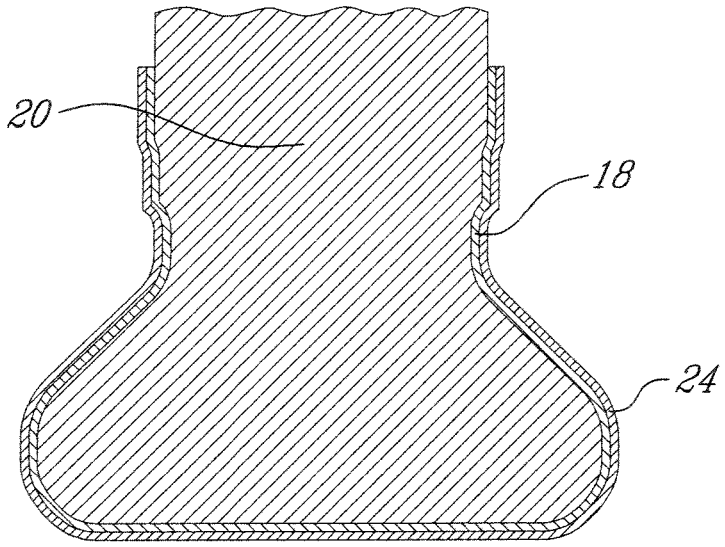
FIG. 5 is an enlarged partial cross-section of another example of the fan blade according to FIG. 3.

Many conventional fan blades are made from titanium alloy. The inventors have found that Ti alloys sometimes bond poorly to nanocrystalline coatings and would otherwise present reliability issues if left unaddressed. It has been found that improved results may be obtained when the nanocrystalline metal coating is applied to an intermediate bond coat of electroless Ni plate instead of plating directly to the titanium alloy substrate. Therefore, referring to FIG. 5, in one aspect the present approach involves the application of an intermediate bond coat 18 to the titanium base material of the dovetail 20, the intermediate bond coat being composed of an electroless nickel plate 18 applied using a plating technique to treat the titanium dovetail surface(s), prior to the application of the outer nanocrystalline coating 24. The electroless nickel bond coat 18 therefore provides a substrate which will yield good bond strength and reliable plating performance with the subsequently applied nanocrystalline coating 24 deposited overtop. The thickness of the electroless Ni plate bond coat 18 may vary depending on the application. In one example, the thickness of the electroless nickel plate bond coat 18 is in the range of 0.00005 inch (0.00127 mm) to 0.0002 inch (0.00508) thick, but it may optionally be up to 0.001 inch (0.0254 mm) thick. It is to be understood that the intermediate bond coat may be composed of other metals than Nickel, and will depend on the material of the substrate (i.e. the root), as well as that of the nanocrystalline metal coating.

The presently described process may be applied in original manufacturing, or as a repair in which the nanocrystalline coating 24 is added to the dovetail 20 of a blade 12 which has already been in service. In one example, the repair is applied to a Ti fan blade which has previously had no nanocrystalline coating but has experienced wear in the field. The repair may involve, as necessary, an initial step of preparing the worn or damaged region by stripping any pre-existing coating and/or cleaning the surface, which may also include removing any uneven or damaged surfaces, and then the application of a nanocrystalline metal coating over this region. The repair may be applied to any suitable blade composition and configuration. In another example, a previously nanocrystalline-coated blade may be refurbished by a strip and recoat process, similar to that described above, either as a part of a regular engine maintenance program or as an on-demand repair, as required. In another example, the coating may be applied as a preventative measure to protect a previously uncoated blade still substantially undamaged by fretting, galling or windmilling wear, as the case may be.

The addition of the nanocrystalline coating 24 to the Ti substrate of the blade dovetail 20 may provide a fatigue credit to the blade dovetail design. The particular nanocrystalline coating may be selected to allow a desired heat transfer and/or anti-galling performance. Lubricity of the nano coating may be adjusted to make assembly of the dovetail into the rotor hub slot easier, and perhaps reducing or eliminating the need for lubricants during assembly.

In another example, a conventional nickel coating (i.e. non-nanocrystalline) may be applied to the fixing portion of the metal airfoil blade which engages the rotor hub, to provide an improved blade fixing arrangement according to the present invention. The coating may be applied by plating, vapour deposition or any other suitable process.

The above description is meant to be exemplary only, and one skilled in the art will recognize that changes may be made to the embodiments described without departing from the scope of the invention disclosed. For example, any suitable nanocrystalline coating and manner of applying the coating layer may be employed. The nanocrystalline coat may be placed only in regions of high stress, wear, etc, or may be placed over a greater region of the dovetail and/or blade. The coating may be provided to impede fretting or galling of the blade in use, and/or to prevent wear due to windmilling when the engine is not in use. Still other modifications which fall within the scope of the present invention will be apparent to those skilled in the art in light of a review of this disclosure, and such modifications are intended to fall within the appended claims.

The invention claimed is:

1. An airfoil blade of a gas turbine engine comprising a root configured for mating attachment with a cooperating rotor hub and an airfoil extending away from the root, the root defining a proximal end including a dovetail portion having pressure side and suction side surfaces, the root being composed of a first metal and having a nanocrystalline metal coating over at least a portion of the root, the nanocrystalline metal coating being composed of a second metal different from the first metal, the dovetail portion includes pressure side and suction side surfaces, said portion of the root having the nanocrystalline metal coating thereon being disposed on the dovetail portion, wherein the nanocrystalline metal coating is disposed exclusively on the pressure side surface of the dovetail portion.

2. The airfoil blade of claim 1, wherein an intermediate bond coat is disposed between the nanocrystalline metal coating and the first metal of the root.

3. The airfoil blade of claim 2, wherein the intermediate bond coat is an electroless plate.

4. The airfoil blade of claim 3, wherein the electroless plate is composed of nickel and the first metal of the root is titanium or a titanium alloy.

5. The airfoil blade of claim 2, wherein the intermediate bond coat has a thickness of between 0.00005 inch and 0.001 inch thick.

6. The airfoil blade of claim 1, wherein the nanocrystalline metal coating has a thickness of between 0.001 inch and 0.008 inch.

7. The airfoil blade of claim 6, wherein the thickness of the nanocrystalline metal coating is about 0.005 inch.

8. The airfoil blade of claim 1, wherein the nanocrystalline metal coating is non-constant within said at least a portion of the root.

9. The airfoil blade of claim 1, wherein the nanocrystalline metal coating has an average grain size of between 10 nm and 500 nm.

10. The airfoil blade of claim 9, wherein the average grain size of the nanocrystalline metal coating is between 10 nm and 15 nm.

11. The airfoil blade of claim 1, wherein the second metal of the nanocrystalline coating is different from a third metal of the cooperating rotor hub.

12. The airfoil blade of claim 1, wherein the nanocrystalline metal coating is a pure metal.

13. The airfoil blade of claim 12, wherein the pure metal is selected from the group consisting of: Ni, Co, Ag, Al, Au, Cu, Cr, Sn, Fe, Mo, Pt, Ti, W, Zn, and Zr.

* * * * *